US010619364B2

(12) United States Patent
Weinreich

(10) Patent No.: US 10,619,364 B2
(45) Date of Patent: Apr. 14, 2020

(54) ADJUSTABLE DECKING AND PLANK REMOVAL TOOL WITH VIBRATORY-ASSIST

(71) Applicant: Benjamin Weinreich, Sykesville, MD (US)

(72) Inventor: Benjamin Weinreich, Sykesville, MD (US)

( * ) Notice: Subject to any disclaimer, the term of this patent is extended or adjusted under 35 U.S.C. 154(b) by 111 days.

(21) Appl. No.: 15/898,416

(22) Filed: Feb. 16, 2018

(65) Prior Publication Data

US 2018/0305941 A1 Oct. 25, 2018

Related U.S. Application Data

(60) Provisional application No. 62/459,871, filed on Feb. 16, 2017.

(51) Int. Cl.
*B66F 3/00* (2006.01)
*E04G 23/00* (2006.01)
*E04G 23/08* (2006.01)

(52) U.S. Cl.
CPC ..... *E04G 23/006* (2013.01); *E04G 23/08* (2013.01); *E04G 2023/085* (2013.01)

(58) Field of Classification Search
CPC ..... B66F 3/00; B66F 15/00; B66F 19/00
See application file for complete search history.

(56) References Cited

U.S. PATENT DOCUMENTS 5,435,610 A * 7/1995 Roberts ..... E04F 21/22 254/11
6,105,935 A * 8/2000 Wagner ..... B25C 11/00 254/21
6,453,774 B1 * 9/2002 Khachatoorian ..... E04D 15/003 254/131.5
6,918,321 B1 * 7/2005 Whittaker ..... E04D 15/003 254/131.5
8,573,561 B2 * 11/2013 Su ..... B66F 15/00 254/129
8,789,810 B2 * 7/2014 Weinreich ..... B66F 15/00 254/131
10,137,513 B2 * 11/2018 Weinreich ..... B23D 45/003
2008/0191180 A1 * 8/2008 Gaunt ..... E04F 21/22 254/11
2012/0313060 A1 * 12/2012 Weinreich ..... B66F 15/00 254/131
2018/0305941 A1 * 10/2018 Weinreich ..... E04G 23/006

* cited by examiner

*Primary Examiner* — Lee D Wilson
(74) *Attorney, Agent, or Firm* — Royal W. Craig; Gordon Feinblatt LLC

(57) ABSTRACT

A versatile lever-type decking and plank removal tool for more efficiently prying floor-boards from deck foundations and floor-joists to which they are nailed. The decking and plank removal tool uses an adjustable demolition head having an offset inverted hook to tear off any deck board in any configuration in seconds with a minimum of effort, allowing the user to remain completely upright for the entire process. An optional vibratory-assist module is also disclosed.

2 Claims, 4 Drawing Sheets

ADJUSTABLE DECKING AND PLANK REMOVAL TOOL WITH VIBRATORY-ASSIST

CROSS-REFERENCE TO RELATED APPLICATION(S)

The present application derives priority from U.S. Provisional Patent Application Ser. No. 62/459,871 filed 16 Feb. 2017.

BACKGROUND OF THE INVENTION

1. Field of the Invention

The present invention relates generally to demolition tools and more particularly, to an adjustable decking and plank removal tool with vibratory-assist mechanism for efficiently prying floor-boards from deck foundations and floor-joists to which they are nailed.

2. Description of the Background

Outdoor decks comprise a series of deck boards nailed side-by-side atop a foundation of deck joists. The deck boards are attached to the joist by long (3") nails which have been driven through the boards into the joists. From time to time it is necessary to replace deck boards which deteriorate, or more typically the entire deck. This entails removing the deck rails and prying up the nailed deck boards. Most weekend warriors use a crowbar to pry up the deck boards. The flat blade of the crowbar slides down between deck boards and the user levers each board off the foundation. Unfortunately crow bars have a small and narrow blade, and require gradual working from one end of the deck board toward the other. This can take hours and is entirely unsuitable for demolition professionals.

The present inventor provided a solution with his U.S. Pat. No. 8,789,810 issued 29 Jul. 2014. The '810 patent disclosed a versatile lever-type decking and plank removal tool for efficiently prying floor-boards from deck foundations and floor-joists to which they are nailed. The decking and plank removal tool (commercially named "Demo-Dek™) will tear off any deck board in any configuration in seconds with a minimum of effort, allowing the user to remain completely upright for the entire process. However, the inverted pry-hook was fixed in dimension, and only suitable for use on a fixed-size deck plank. The present inventor has since learned that contractors encounter various sized planks, and have found other uses for the Demo-Dek™ such as prying planks from docks that entail much larger planks and larger nails or screws.

SUMMARY OF THE INVENTION

It is, therefore, a primary object of the present invention to provide a decking and plank removal tool as with the Demo-Dek™ that is adjustable to accommodate different-sized planks.

It is still another object of the present invention to provide a decking and plank removal tool as with the Demo-Dek™ but with a vibratory pry-head to assist in removing difficult planks.

In accordance with the foregoing objects, the present invention is a versatile lever-type decking and plank removal tool of simple, inexpensive and extremely rugged construction for efficiently prying floor-boards from deck foundations and floor-joists to which they are nailed. A demolition head is adjustably attached to the rectilinear portion at the opposing end of the handle. To accomplish adjustability (for different plank thicknesses) the elongate handle is formed at one end with a series of uniformly-spaced through-holes. The demolition head further comprises a triangular-shaped heel member having two legs and a base, a pair of externally-threaded pins protruding rearward from a leg, and a hook member joined to the base of said heel member and protruding downward therefrom, the hook being defined by an angular U-shaped receptacle for gripping an edge of a deck board. A pair of internally-threaded screws pass through the through-holes of the handle for screw insertion of said pins. The demolition head may be selectable mounted in any of the through holes to adjust the head for plank thickness. In another embodiment, a vibration module is fixedly attached to the demolition head to assist in removal.

The foregoing design in combination with other design details to be described result in a most effective, rugged and reliable decking and plank removal tool that speeds removal of deck boards and minimizes damage. In addition, the device may be scaled in size to remove smaller boards and planks, such as hardwood flooring.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

The present invention is an improved decking and plank removal tool for efficiently prying floor-boards from deck foundations and floor-joists to which they are nailed. The decking and plank removal tool will tear off any deck board in any configuration in seconds with a minimum of effort, allowing the user to remain completely upright for the entire process. Moreover, it has a simple, inexpensive and extremely rugged design.

Figure 1:
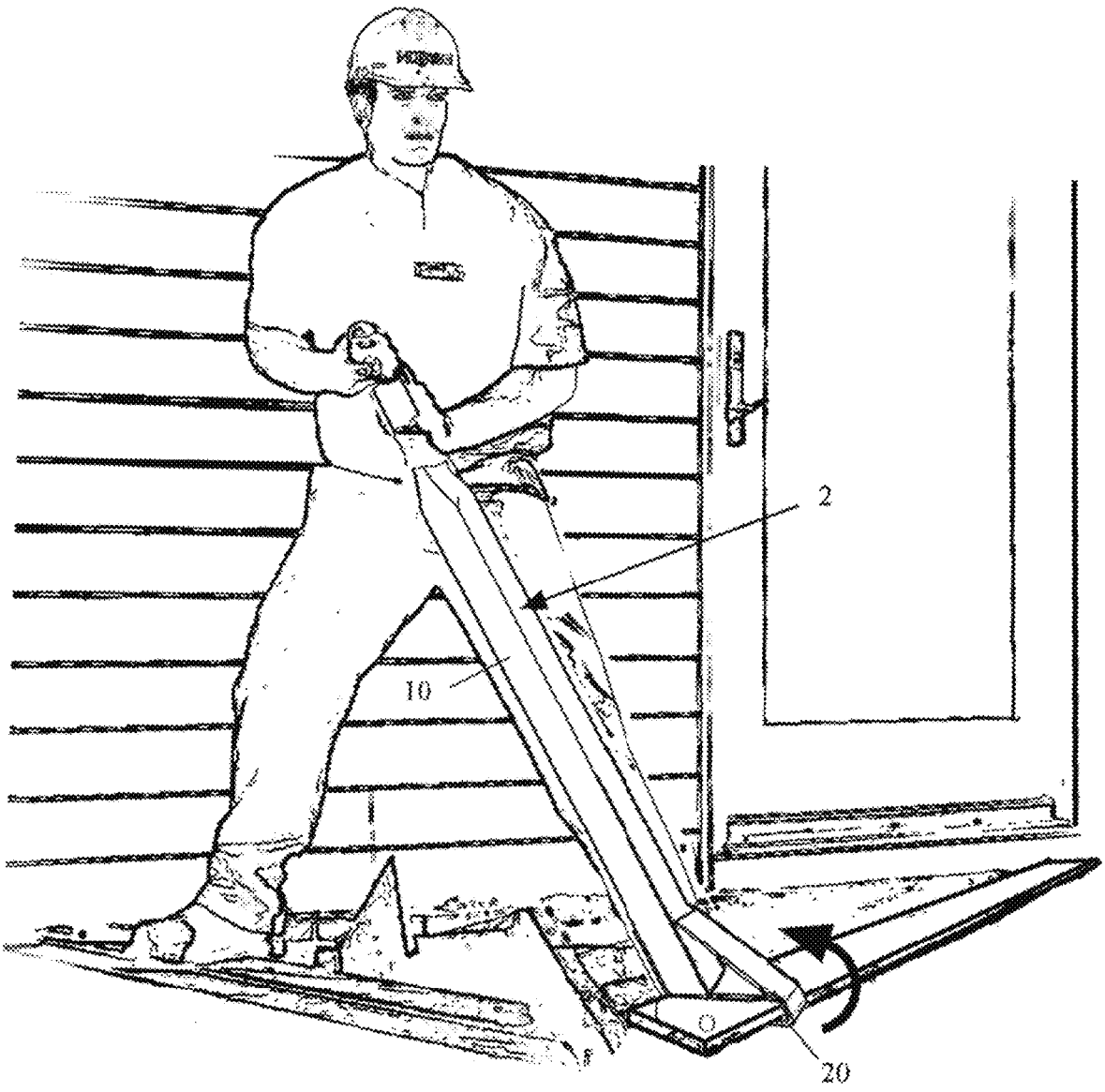
FIG. 1 is a perspective illustration of an adjustable deck board pulling tool 2 with vibratory-assist mechanism 20 according to the present invention in use.

FIG. 1 is a perspective illustration of a deck board pulling tool 2 according to the present invention in use. The tool 2 includes a handle 10 with a unique demolition head 20 fixedly attached to a rectilinear portion of the handle 10. The head 20 hooks around the outside edge (O) of each deck board to be removed, and the user levers (pulls) the tool 2 toward himself. The flat distal base of the handle 10 abuts the topside of the deck board and holds it down. The next adjacent deck board serves as a fulcrum. As the head 20 of pulling tool 2 hooks overtop the outside (O) of the deck board, with the base of the handle 10 holding down the deck board and the next adjacent deck board serving as a fulcrum, the inwardly-hooked configuration of demolition head 20 pulls the outside (O) of the deck board directly up, vertically, along the axis of the nails. The angular configuration affords full 90 degree leverage during the prying operation which fully dislodges 3" nails from the foundation joists below.

In an embodiment the deck board pulling tool 2 comprises an elongate four-to-five foot handle 10 formed from a 1.5" by 2.5" rectilinear (here rectangular) bamboo blank with a rounded grip end (at top) preferably machined into a circular cross-section along approximately a 9" length. The choice of bamboo is important inasmuch as bamboo has a greater tensile strength than steel. The handle 10 retains its 1.5" by 2.5" rectilinear cross-section at the opposing end, where the demolition head 20 is fixedly bolted.

Figure 2:
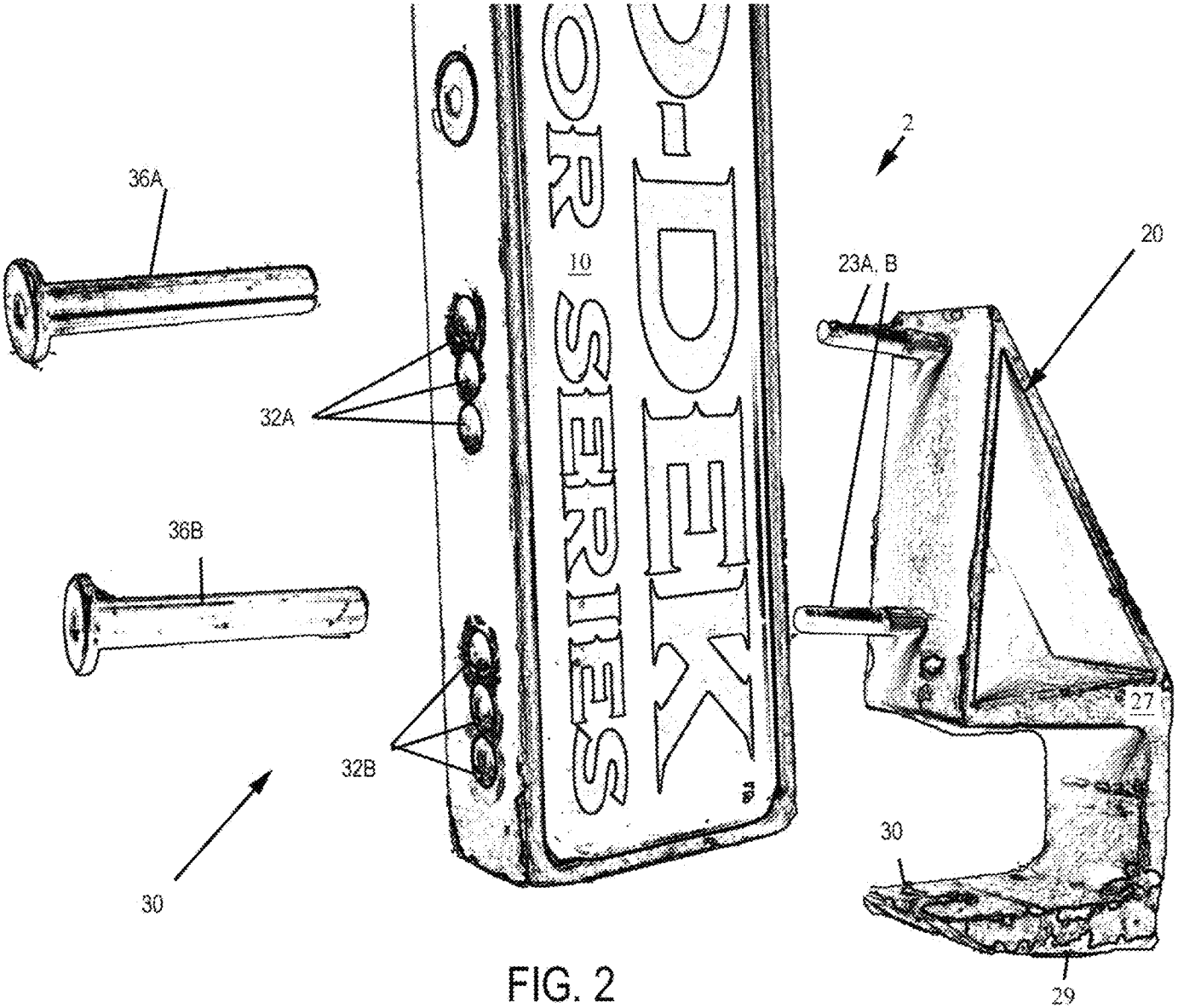
FIG. 2 is an enlarged perspective illustration of an exemplary adjustment mechanism 30 for a deck board pulling tool 2 as in FIG. 1.

FIG. 2 shows an exemplary adjustment mechanism 30 for a deck board pulling tool 2 that allows a contractor to optimize the tool 2 for different board thicknesses. The adjustment mechanism 30 is implemented by forming the demolition head 20 with two spaced mounting pins 23A, B, each preferably externally threaded. Two corresponding series of equally-spaced holes 32 are formed cross-wise through the handle 10 as shown, each hole 32A, B being sized for receiving one of two internally-threaded bolts 36A, B. The spaced mounting pins 23A, B, may be inserted through the handle 10 at a selected pair of holes 32A, 32B to achieve a desired spacing of the under hanging hook 30 of head 20 from the bottom of handle 10, thereby adapting the tool 2 to any of a variety of different plank thicknesses. The internally-threaded bolts 36A, B capture the pins 23A, 23B therein in such a way as to prevent shearing.

The demolition head 20 may be integrally formed or welded from steel strips, and generally comprises a right triangle, the base of which provides a heel 27 that wields the inverted under hanging hook 29, the latter being offset forwardly from the axis of the handle 10 and turned inward and downward from the base of the handle 10. Hook member 29 is attached to and protrudes outward from the heel member 27 at the distal end of the handle 10, initially extending perpendicular to the axis of the handle 10. The hook member 29 hooks back inwardly and downward from the base of handle 10 to form a three-sided receptacle conforming to the edge of the decking boards. The three-sided angular U-shaped receptacle extends downward from and opens inward toward the base of handle 10, and is offset from the base so that the handle 10 pins the inside (I) of the deck board while the hook member 29 lifts the outside (O) of the deck board directly up vertically, along the axis of the nails, using the base of the handle 10 as an anchor.

One skilled in the art should understand that other approaches to adjustability are possible, such as by inserting spacer(s) into a fixed-size demolition head 20.

In some situations, such as with docks larger nails or screws or used and when rusted can make the planks most difficult to remove. The present invention include a vibratory-assist module 40 for demolition head 20 to assist in removing difficult planks.

Figure 3:
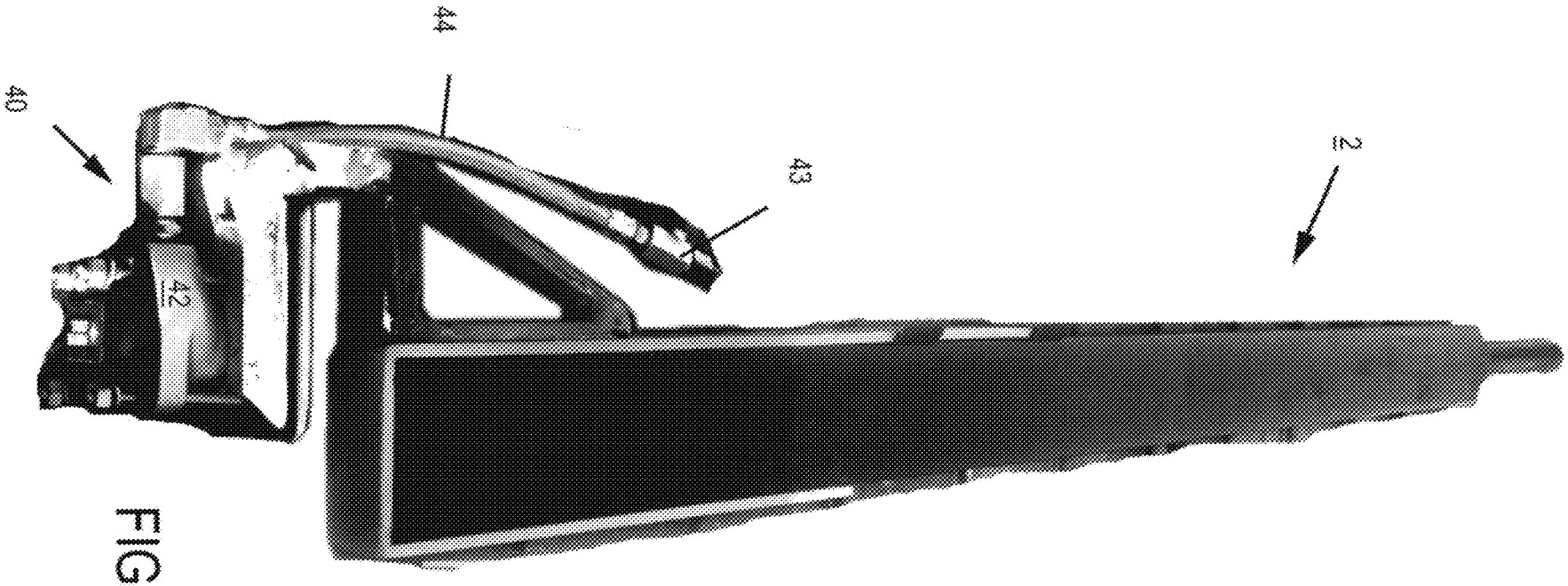
FIG. 3 is a side view of a deck board pulling tool 2 as in FIGS. 1-2 illustrating the vibratory-assist module 40.
Figure 4:
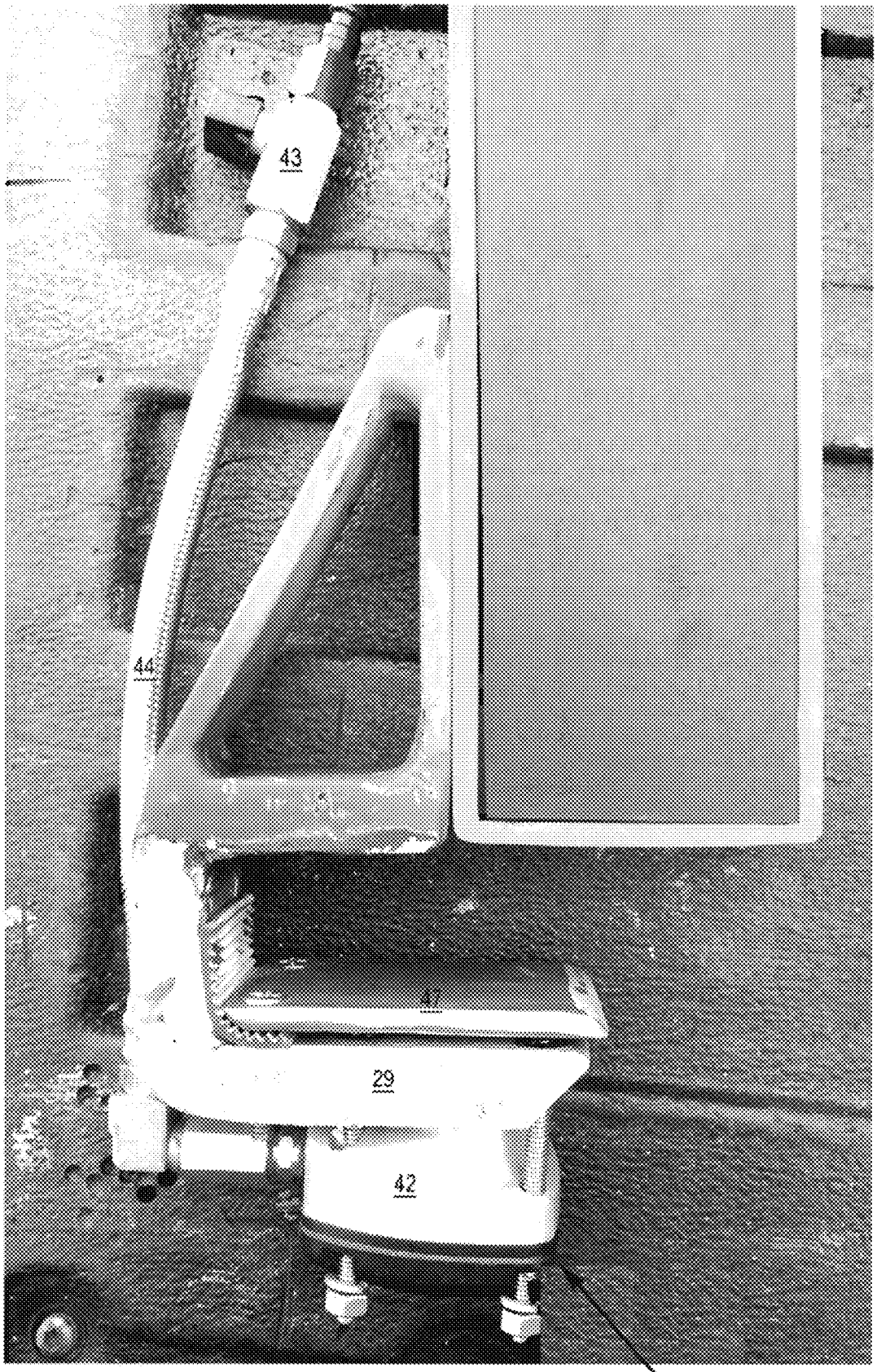
FIG. 4 is a close up view of the vibratory-assist module 40.

FIG. 3 is a side view of a deck board pulling tool 2 as in FIGS. 1-2 illustrating the vibratory-assist module 40, and FIG. 4 is a close up view of the vibratory-assist module 40.

With combined reference to FIGS. 3-4, the vibratory-assist module 40 includes a housing 42 fabricated of any suitable material, including aluminum, stainless steel and the like. The housing 42 is bolted to the underside of hook 29. A pneumatic fluid inlet conduit 44 is provided into the housing 42 which, as a practical matter, is coupled with a suitable source of pressurized fluid, not shown, through a distal screw-threaded fitting 43. Also provided within the body there is a cylindrical actuator chamber which is seated within an impact head (not shown). The impact head functions to deliver a series of impacting blows as a result of pneumatic pressure applied through conduit 44. The blows are transmitted to the underside of hook 29, by which vibratory operation of the tool 2 is achieved. Any suitable compact pneumatic impact generating head capable of generating vibratory impact forces according to a pneumatic pressure externally supplied through conduit 44 may suffice for impact module 40. For example, a wide variety of commercially-available palm nailers are suitable vibratory impact modules 40 inclusive of Porter-Cable Pn350 Or Pn650, Bostitch Pn50, Senco Pc0781, Freeman Pmpn, or any other suitable palm nailer or other pneumatic impact generating head. In the illustrated embodiment, a palm nailer is shown with its impact nose passing through the hook 29 and coupled to an aluminum vibration plate 47 screwed inside the hook 29. The foregoing design speeds removal of deck and dock boards and minimizes damage. If a user can pull with a 300 lb force, the deck board is torqued upward by a two-ton force. Moreover, the device's design allows 100% of the removal force to be selectively applied directly at a single nail, nail by nail, one at a time, and with vibration-assist rusty nails are not a problem. Given its extended range of motion, the device can continuously apply full force to each fastener one-by-one, the force shifting as each preceding fastener fails.

In addition to the foregoing, the device may be adjusted to remove larger or smaller boards and planks.

Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A lever-type decking and plank removal tool for prying deck boards from underlying joists to which they are nailed, comprising:

an elongate handle having a rectilinear cross-section extending to a flat base of said handle, said handle being formed at one end with a plurality of pairs of uniformly-spaced through-holes; and a demolition head removably attached to the rectilinear portion of said handle, said demolition head further comprising, a triangular-shaped heel member having two legs and a base, a pair of externally-threaded pins protruding rearward from a leg, and a hook member joined to the base of said heel member and protruding downward therefrom, said hook being defined by an angular U-shaped receptacle for gripping an edge of a deck board; and a pair of internally-threaded screws passing through one of the plurality of pairs of through-holes of said handle for screw insertion over said pins.

2. A lever-type decking and plank removal tool, comprising:

an elongate handle extending to a base; and a demolition head fixedly attached at the base of said handle, said demolition head further comprising a hook member protruding perpendicularly outward from an axis of said handle and bent at two juxtaposed right angles to defining an inwardly-directed U-shaped receptacle for gripping an edge of a deck board, a reinforcing rib spanning a junction of said hook member and said handle, and a vibration module fixedly attached to said demolition head, said vibration module further comprising a housing attached to the hook member, a fluid actuator in said housing, a fluid conduit in communication with said fluid actuator, and an impact head driven by said actuator for transmitting impacting blows to said hook member as a result of fluid pressure applied through said fluid conduit.

* * * * *